US007766124B2

(12) United States Patent
Horn

(10) Patent No.: US 7,766,124 B2
(45) Date of Patent: Aug. 3, 2010

(54) HIGH RISE EVACUATION SYSTEM

(76) Inventor: Edward H. Horn, 17 Celanova La., Hot Springs Village, AR (US) 71909

( * ) Notice: Subject to any disclaimer, the term of this patent is extended or adjusted under 35 U.S.C. 154(b) by 343 days.

(21) Appl. No.: 11/807,308

(22) Filed: May 29, 2007

(65) Prior Publication Data

US 2008/0296088 A1 Dec. 4, 2008

(51) Int. Cl.
*A62B 1/02* (2006.01)

(52) U.S. Cl. ..... 182/100; 182/133; 182/189; 187/239

(58) Field of Classification Search ..... 182/49, 182/100, 133–136, 189–193; 187/239
See application file for complete search history.

(56) References Cited

U.S. PATENT DOCUMENTS

| | | | | | |
|---|---|---|---|---|---|
| 187,569 | A | * | 2/1877 | Tixier | 182/71 |
| 213,715 | A | * | 3/1879 | Von Mengden | 182/134 |
| 286,850 | A | * | 10/1883 | Sande | 182/193 |
| 298,292 | A | * | 5/1884 | Curtis | 182/141 |
| 315,025 | A | * | 4/1885 | Heath | 182/135 |
| 471,145 | A | * | 3/1892 | Schneider | 182/42 |
| 493,391 | A | * | 3/1893 | Sturtevant | 182/135 |
| 494,217 | A | * | 3/1893 | Miles | 187/251 |
| 565,458 | A | * | 8/1896 | Hoffmann | 182/193 |
| 580,794 | A | * | 4/1897 | Money | 182/135 |
| 598,294 | A | * | 2/1898 | Robbins | 182/142 |
| 696,711 | A | | 4/1902 | Briner | |
| 810,254 | A | * | 1/1906 | Borneman | 182/134 |
| 815,401 | A | * | 3/1906 | Breckon | 182/141 |
| 983,335 | A | * | 2/1911 | Westad | 182/135 |
| 1,116,829 | A | | 11/1914 | McCoy | |
| 1,147,365 | A | * | 7/1915 | Boulieu et al. | 182/131 |
| 1,168,321 | A | * | 1/1916 | Maley | 182/135 |
| 1,766,566 | A | * | 6/1930 | Tucker | 182/100 |
| 1,982,482 | A | * | 11/1934 | Rhodes | 188/67 |
| 2,311,352 | A | * | 2/1943 | Seiler | 182/136 |
| 2,965,193 | A | | 10/1960 | Murphy | |
| 2,963,178 | A | * | 12/1960 | Walker | 414/139.5 |
| 3,075,611 | A | * | 1/1963 | Baringer | 182/134 |
| 3,078,951 | A | * | 2/1963 | Schneebeli et al. | 182/134 |
| 3,126,071 | A | * | 3/1964 | Basset | 472/2 |
| 3,480,108 | A | * | 11/1969 | Cooper | 182/133 |
| 3,658,151 | A | * | 4/1972 | Wisdom | 182/135 |
| 3,677,367 | A | * | 7/1972 | Shotmeyer | 182/136 |
| 3,814,210 | A | * | 6/1974 | Hoffman | 182/6 |
| 3,894,613 | A | * | 7/1975 | Elizondo | 182/43 |
| 3,927,734 | A | * | 12/1975 | Brunette et al. | 182/193 |
| 3,938,620 | A | * | 2/1976 | Nothiger | 182/135 |
| 4,276,958 | A | * | 7/1981 | Skaalen | 182/135 |
| 4,301,891 | A | * | 11/1981 | Harbian | 182/135 |
| 4,310,070 | A | * | 1/1982 | Mastrogiannis | 182/134 |

(Continued)

*Primary Examiner*—Katherine W Mitchell
*Assistant Examiner*—Colleen M Quinn
(74) *Attorney, Agent, or Firm*—Dennis B. Haase

(57) ABSTRACT

A system for the evacuation of persons from a multi story structure during circumstances in which the normal escape mechanisms such as stairs and elevators are unusable for any reason. The system mounts externally of the affected structure and provides at least one evacuator upon which a person may ride in a controlled descent from an area of danger to an area of relative safety. The evacuator rides on a post and the evacuee may control the speed of his or her descent with a simple braking mechanism. A safety belt and foot rests provide a sense of security during the descent from danger.

9 Claims, 4 Drawing Sheets

U.S. PATENT DOCUMENTS 4,341,286 A * 7/1982 Gregory ..... 182/10
4,458,781 A * 7/1984 Ellis et al. ..... 182/5
4,488,621 A * 12/1984 Schiewe ..... 187/347
4,512,440 A * 4/1985 Bixby ..... 182/146
4,703,832 A 11/1987 Fontenot
4,781,269 A * 11/1988 Clay ..... 182/5
4,887,694 A * 12/1989 Ho ..... 182/82
4,928,791 A * 5/1990 Hong ..... 182/135
5,029,669 A * 7/1991 Lew et al. ..... 182/42
5,101,935 A * 4/1992 LaBianca ..... 182/236
5,234,075 A * 8/1993 Lowden ..... 182/135
5,860,490 A * 1/1999 Petti et al. ..... 182/134
6,662,905 B2 * 12/2003 Sors ..... 187/347
6,814,186 B1 * 11/2004 Harbers, Jr. ..... 182/231
6,955,244 B2 10/2005 Yerman
7,059,451 B2 * 6/2006 Richey et al. ..... 187/239
2002/0139619 A1 * 10/2002 Qiu et al. ..... 187/239
2008/0035425 A1 * 2/2008 Meitus et al. ..... 182/129

* cited by examiner

HIGH RISE EVACUATION SYSTEM

The present invention relates generally to devices for exiting structures during emergency situations and, more particularly, to a novel system for assisting otherwise trapped persons in a high rise structure.

BACKGROUND OF THE INVENTION

1. Field of the Invention

Since man figured out that he could make optimum use of limited space by building vertically, others have perceived the potential danger to the occupants of such structures above ground level. The burning question is: how do occupants get to ground safely?

Since the tragedy of 9/11, the problem has been moved to the forefront in the minds of everyone who lives and/or works, or whose friends and loved ones live and/or work in a high rise structure. Elevators may or may not work and, depending on the nature of the pending disaster, may be dangerous if used. Fire escapes have limited value and in some instances, no value, particularly if the structure is more than two or three floors. The venerable ladder may have some use below a third floor, making it of some benefit below a third floor and in residential environments, but rather of no use in any other situations, and one can not reasonably anticipate a fireman's net to be at his or her beck and call, and, even then, there is an inherent reluctance to trust and jump.

2. Overview of the Prior Art

As early as 1902, Briner, in his U.S. Pat. No. 696,711, perceived an element of danger and reluctance to use the steps outside the wall of a structure as a fire escape and came up with the idea of a long pipe with a weight riding inside. A hand grip on the outside allowed a human to hang on to the grip and ride it down as the weight came up.

Briner, perhaps, thought his device was an improvement on Robbins U.S. Pat. No. 598,294. Robbins used a carriage 24 and employed hydraulics in the tube to assist in the lowering process. It was not.

In 1914, McCoy proposed a modified form of the traditional fireman's pole which one could slide down to safety. A year later Boulieu and Brady patented a pair of baskets, one of which would go up as the other goes down. Cables next to the baskets permitted occupants to mechanically grip the cable to slow down the descent. Murphy in his U.S. Pat. No. 2,965, 193, proposes making the pole telescoping, thereby making the device smaller and portable.

In more current times, Fontenot in his U.S. Pat. No. 4,703, 832 combines several features of the prior art to provide a pole with a platform which, when not in use, lies back in a horizontal attitude. Finally, Yerman, in his U.S. Pat. No. 6,955, 244, issued in 2005, proposes a chair which rides down the side of a structure and is controlled by the person in the chair.

Also considered, but not described, are several patents relating to scaffolding and devices for raising and lowering construction materials and workers.

SUMMARY OF THE INVENTION

Having provided a brief synopsis of the available devices, including those which are the subject of patents, it is an objective of the present invention to provide an alternative to those devices discussed which will facilitate evacuation of multi story structures.

It is another objective of the present invention to provide occupants of high rise structures with a system for evacuation in the event it should become necessary, and conventional means, such as elevators, is inaccessible, which is relatively safe, even for small children and senior citizens. An objective, related to the foregoing, is to provide an evacuation system which provides a sense of security such that the occupants who need it are not unduly afraid of using the device and have confidence in it.

Yet another objective is to provide a system for evacuation of multi story structures which is capable of OEM construction, as well as after market installation.

The foregoing advantages and objectives, as well as others, will become apparent to those skilled in the art when the Description of a Preferred Embodiment of the Invention is read in conjunction with the drawings wherein:

DETAILED DESCRIPTION OF A PREFERRED EMBODIMENT

The concept of high rise evacuation is a subject which is not foremost in the minds of most citizens, at least not until one is faced with the prospect.

As land becomes less and less available, of necessity structures tend to go up rather than out. Engineers and architects strive to make their structures fireproof and even earthquake proof. No matter how herculean the effort, no one can guarantee the absolute safety of persons 20, 50 or even 100 floors above ground if there is a disaster which adversely effects the ability of those folks to survive such an occurrence. There is a natural resistance to jumping from a window into a net, or even jumping into a fireman's basket at the end of a ladder. If a person is to overcome their fears [most often a fear of free falling] sufficiently to take a risk to avoid a high probability of disaster, the means of their escape must be capable of instilling a sense of security that the risk of escape is less than the consequences of not. That is the principal objective of the present invention.

Figure 1:
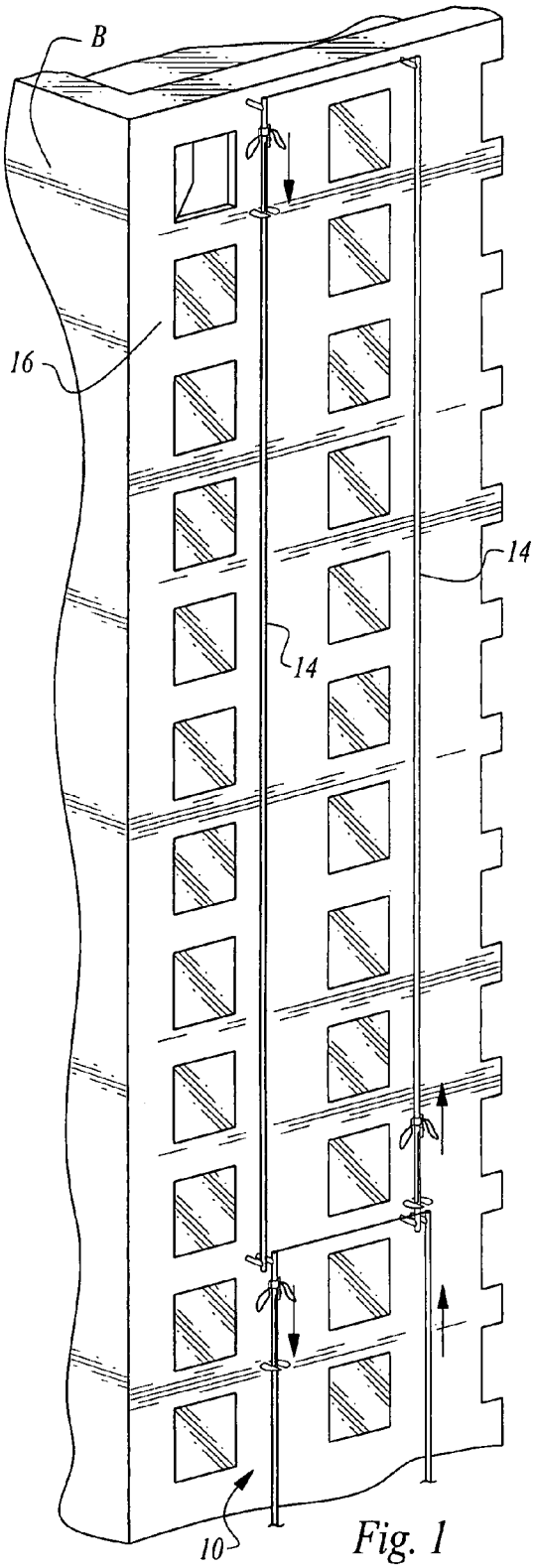
FIG. 1 is a pictorial view of a portion of the side wall of a multi story structure illustrating how the system of the present invention would operate.
Figure 2:
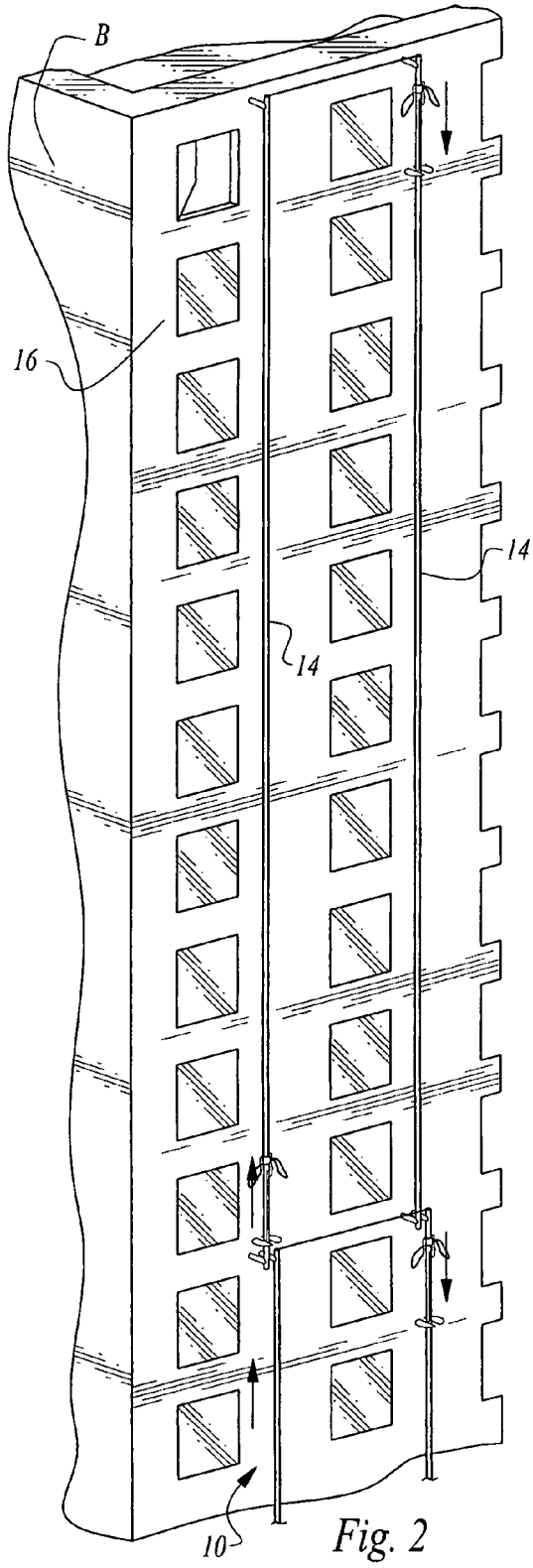
FIG. 2 is a view similar to that of FIG. 1, illustrating a reversal of the movement of the carriage.

Having discussed the environment in which the present invention has particular, although not exclusive, utility, and referring initially to FIGS. 1 and 2, a depiction, which is typical of a high rise structure, in the nature of an outer wall portion of a building B, is shown. A high rise evacuation system 10, constructed in accordance with the present invention, is pictured as it would appear to an outside observer, mounted to the side of the building B.

The system 10 includes, in its preferred embodiment, a pair of transporters, or evacuators, 12, adapted to ride up and down on a tubular post 14. Each of two companion posts 14 are secured in any suitable well known manner to the face 16 of the building B. Since it is well known that materials have their strength limits, the system 10 contemplates that, depending on the height of the structure, it will be built in a number of serially spaced overlapping units, perhaps in units of 10 stories or less, each. Each unit is aligned with its successive unit in such a manner that an evacuee can easily transition from one unit to the next as he or she moves to safety.

Figure 3B:
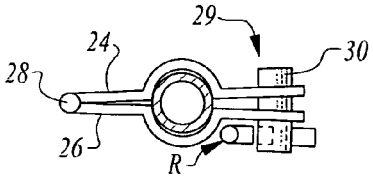
FIG. 3B is a top plan view of the locking mechanism of the brake system in its unlocked position with the carriage stopped.
Figure 4B:
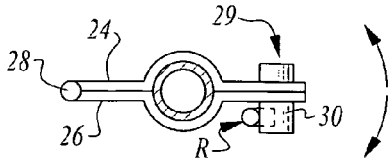
FIG. 4B is a view similar to that of FIG. 3B, but illustrating the brake mechanism in its locked position.
Figure 3A:
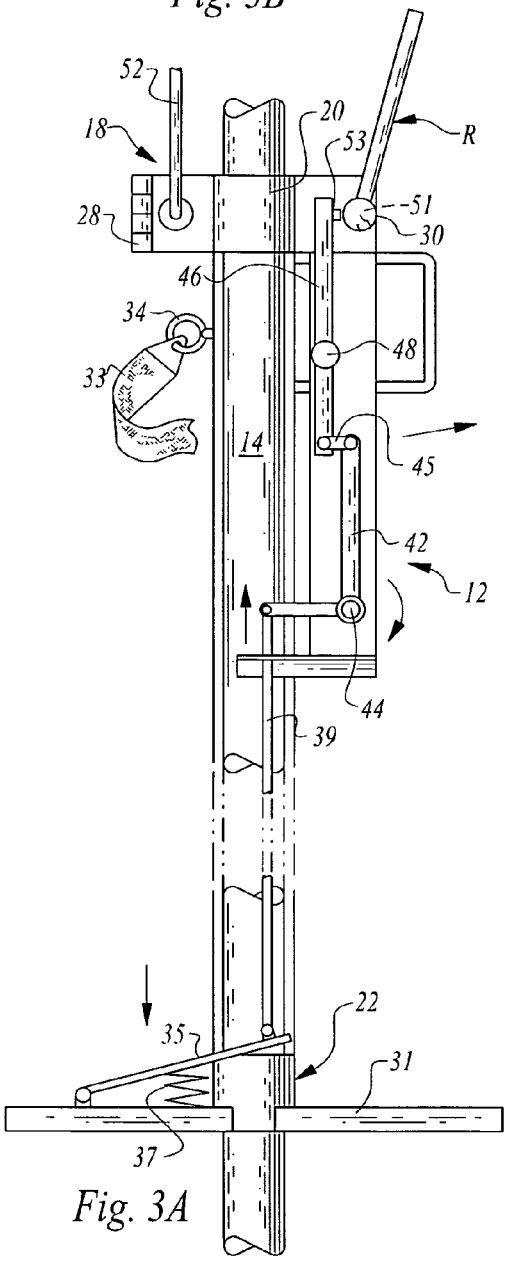
FIG. 3A is a side elevation with the pole partially sectioned to illustrate the carriage and braking system in greater detail.
Figure 4A:
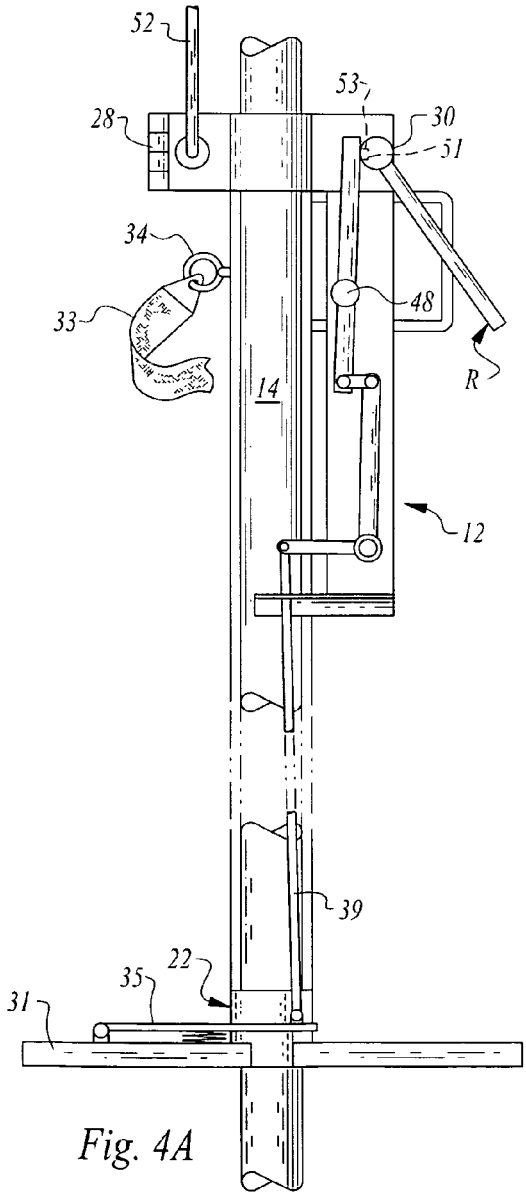
FIG. 4A is a view similar in content and position to FIG. 3A, but illustrating the brake mechanism in the unlocked position.
Figure 8:
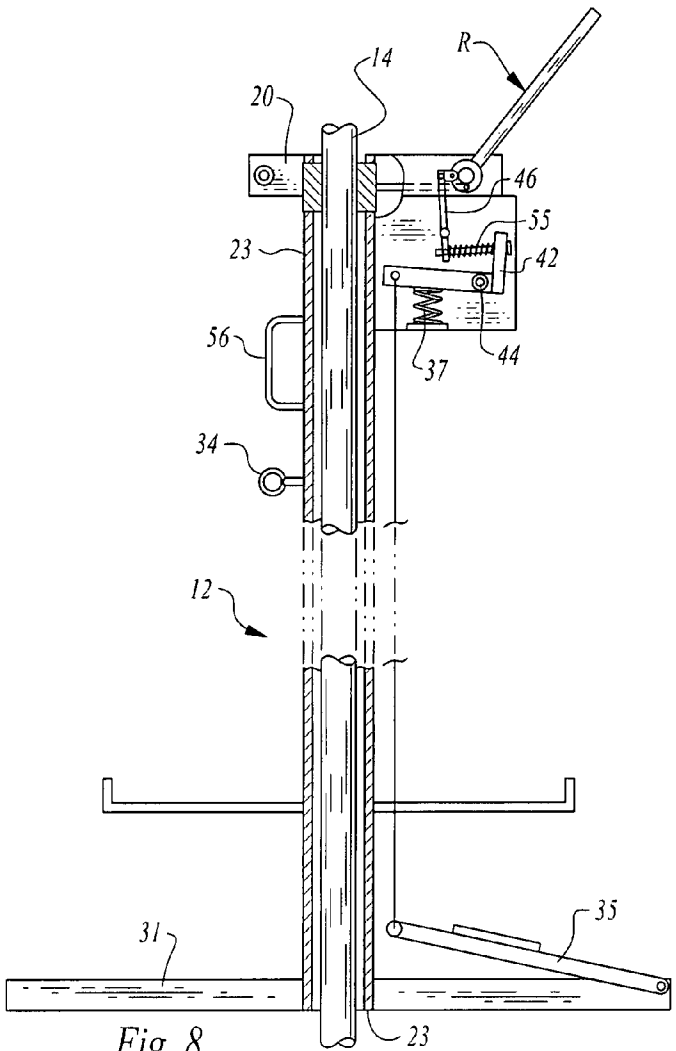
Figure 7:
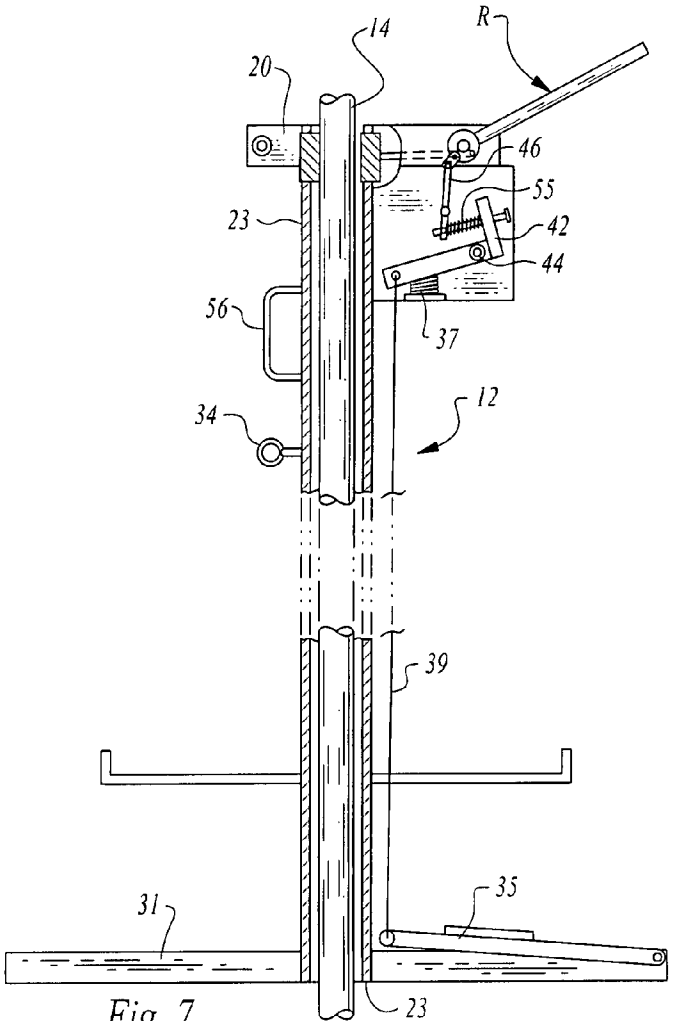
FIG. 7 is a view similar in content to that of FIG. 2, but illustrating a slightly modified structure of the transporter and showing the brake mechanism in its open or unlocked position; and, FIG. 8 is a view similar to FIG. 7, showing the brake mechanism in its locked and secure position.

A dominant feature of the system is the evacuator 12 which receives and supports an evacuee during the evacuation process. Referring primarily to FIGS. 3A and 4A, the evacuator 12 is illustrated in considerable detail as it would appear within the environment of the evacuation system of the present invention. The device includes an upper sleeve 20 and a lower sleeve 22, each sleeve being interconnecting and circumscribing a tubular post 14, to thereby slidably secure the evacuator to the post 14. The lower sleeve 22 includes a platform 31 with foot rests so that an evacuee can step from an open window, or other access opening adjacent the system, onto the evacuator and feel that he or she is on solid footing, thereby adding to a feeling of security in the face of impending danger. A safety belt 33 is then placed about the evacuee and is secured in an eye bolt 34. Referring to FIGS. 7 and 8, the upper and lower sleeves may be interconnected such as by a tube 23, so as to provide a rigid and confident structure. It will be appreciated that several other devices may be employed in place of the tube in joining the sleeves.

It is imperative for those who have little alternative but to use the evacuation system, that the system visually appear, and, in fact, be, relatively safe and readily operable by them and pose considerably less risk than any of the apparent alternatives. Time is, obviously, of the essence. Important to that sense of security is the ability to stop, start and control the descent of the evacuator 12 to thereby ameliorate any concern about the prospect of a free fall. Safety and confidence are achieved by the provision of the evacuator, which includes a manually operable braking system 18, which will not only control speed, or rate of descent, but stop descent if and when the evacuee wishes to do so.

To this end, the upper sleeve 20, in its simple form, serves the dual purpose of support for the evacuator on the post 14 and as a controllable brake. As best seen in FIGS. 3B and 4B, the brake shown acts in the nature of a frictional clamp about the post 14. For the purpose of functioning as a brake at essentially eye level, the sleeve 20 is, in this embodiment, split into clamping halves 24 and 26, which are hingeably affixed at one end 28 by any suitable well known means. At the other end, a threaded cam clamping device 30 selectively squeezes the halves 24, 26 together to make progressively increased or decreased frictional contact with the post to control movement of the evacuator. The control function of the split halves may be enhanced in several well known ways, such as by putting frictional pads along the inner surface of the halves 24, 26 which contact the post.

It will be understood that this type of frictional brake, not unlike an automotive band brake, is but one of several different types of braking mechanisms that will occur to those skilled in the art. However, this particular brake has been chosen for its simplicity and because its operation is immediately comprehensible to an evacuee under stress and, thus, adds to the evacuee's confidence in the safety and security of the system. It will also be understood that the lower sleeve 22 may also include a braking system, where desirable, and is within the contemplation of the invention.

When a disaster happens and getting out of a high rise structure becomes an imperative, it is not realistic to expect that cool heads will prevail. Otherwise stated, it is not only necessary to have an effective evacuation system with a controllable braking system, it must have other appropriate safeguards, while being readily operable by the most flustered, if not panicked, evacuee. With these simple facts in mind, the present system provides those features in a package which is simplicity itself for an evacuee on the system's evacuator to actuate the braking system.

Still referencing FIGS. 3A and 3B and 4A and 4B, the braking system found in the evacuator includes both hand and foot lock controls. The upper and primary control is the manually operable brake handle R, which permits mechanical tightening and release of a threaded cam clamping device 30 with a movement between a full open position (FIGS. 4A and 4B) and a full lock position (FIGS. 3A and 3B). The clamping device connects the halves 24, 26 and, by means of a threaded screw and cam arrangement 29, tightens and loosens the halves with movement of the handle to permit the evacuee to feel and control the evacuator on the post by positive braking or permitted descent, as desired by the evacuee. In FIGS. 7 and 8, a slightly modified linkage is provided, although it performs a substantially identical function. There is one additional feature, however, in that an adjustment rod 55 is provided which permits a more precise fit of the pin in its receiving aperture 51.

In order to insure stability of the evacuator upon being mounted and operated by an evacuee, the controllable braking system is constituted to both selectively hold the evacuator and control its speed of descent. As a means of stabilizing the evacuator during mounting by an evacuee, a foot actuated safety pedal lock 35 is provided, where it is pivotally mounted at the lower platform, within easy reach of the evacuee's foot resting on the platform or foot rest 31. A spring, or like biasing device, 37 normally biases the safety brake pedal lock 35 away from the foot rest, thereby freeing the brake mechanism from its locked position.

In this illustrated case, there is a single brake, and it is located in the upper sleeve 20. The safety brake pedal 35 is designed to lock the brake through a relatively simply, yet positive, mechanical linkage provided, which comprises an upstanding link in the nature of a rod or cable 39, which moves vertically in response to movement of the safety brake pedal 35. The rod 39 connects pivotally to one end of the right angle link 42. The link 42 is rocked about a pivot pin 44 by movement of the pedal 35, and its upper end connects to a locking link 46 by means of link 45. The link 46 rotates about pin 48 toward the brake handle as the pedal is depressed causing the locking pin 53 to engage the camming screw 30 when the camming screw is in its FIG. 3A position. In that position, the camming screw 30 has drawn the two split halves together to clamp them about the post and the provision of suitable cam makes the system capable of accomplishing the grip in one half turn of the handle which rotates it. A receiving aperture 51 in the camming screw 30 is aligned to receive the pin 53, resulting in selectively securing the brake system in its engaged position. An evacuee is then able to comfortably mount the evacuator without undue concern of inadvertent descending movement.

While a mechanical linkage has been chosen for its reliability and visual appearance, clearly other forms, e.g., electrical systems, may be within the contemplation of the invention. In the system under discussion, however, in order to release the locking mechanism to begin descent down the post, an evacuee need only step off the brake pedal lock 35, and the pin 53 will retract from the receiving aperture 51 releasing the brake handle R, at which time the evacuee may move the handle upwardly, resulting in an apportioned release of the brake to permit a controlled descent to begin.

The safety belt is intended to encircle the evacuee beneath the shoulders, thus freeing the arms to manipulate the hand control to control the brake mechanism. Simple downward movement of the control handle R permits the evacuee to stop the evacuator or control it to effect a desired descent. A safety grip 56 secured to the post provides added security, particularly on mounting and dismounting of the evacuator.

Having described the principal elements of the system, the system itself is important to the success of any rescue effort from a high rise structure. The posts 14 have already been described, and two of them in close proximity make up the superstructure of the system. An evacuator rides on a post and, in a preferred embodiment, two such evacuators may be used, there being one on each of two posts. In so doing the speed and efficiency of the process of evacuation is enhanced.

Figure 5:
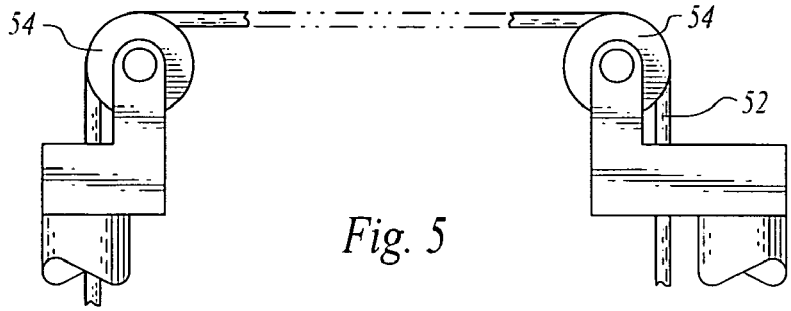
FIG. 5 is an illustration of the cross over cable arrangement.

When two evacuators are employed, the system is designed so that as one evacuator descends by gravitational forces, the companion evacuator ascends, as one counterbalances the other. In order that the movement of the evacuators is coordinated, a cable is provided which interconnects companion evacuators. The cable 52 [FIG. 5] runs over a pair of pulleys 54 and is connected at the respective ends to the evacuators. The posts themselves are connected to the outside wall of the structure and in immediate proximity to a window, or similar opening, from the interior of the structure. In this way, evacuees can quickly access an evacuator when the need arises. It is further contemplated that the entire system could be folded against the outer wall of the structure or even into a recess constructed for the purpose, particularly in original construction, as distinguished from an after market modification.

It will now be seen that as one evacuator descends, its companion ascends and will arrive to accommodate another evacuee, and the process repeats itself until the task is complete.

At the base of each system segment there shall be an opening in the structure which permits an evacuee to transfer from such segment to a successive segment and, thus, descend down the structure to safety.

Figure 6:
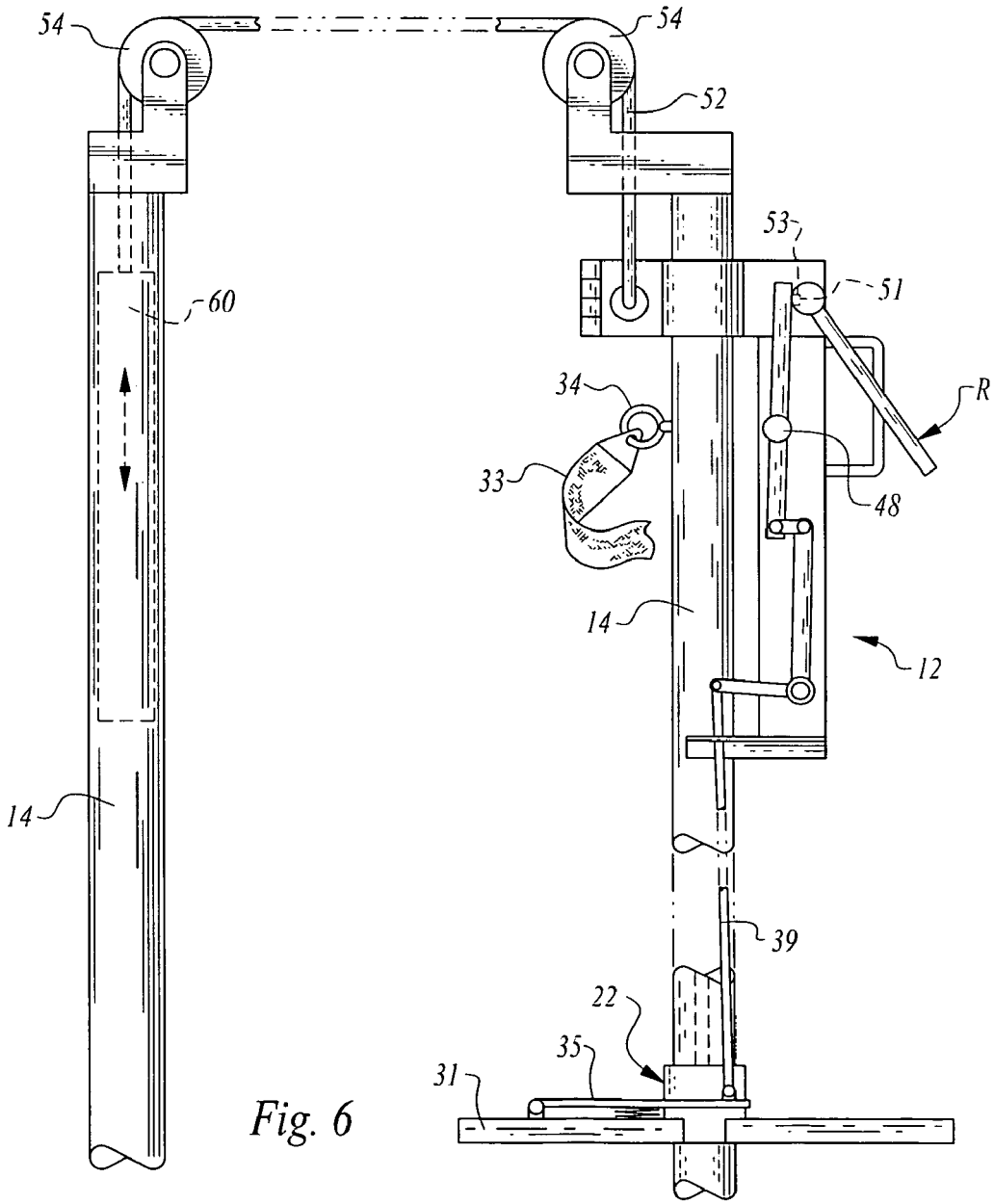
FIG. 6 illustrates a modified single carriage embodiment of the invention.

A slightly modified version of the system is illustrated, particularly in FIG. 6. The FIG. 6 embodiment suggests a workable system under circumstances where the use of companion evacuators is either impractical or impossible.

The modification suggests the use of a single evacuator in conjunction with an appropriate dead weight 60 which rides in a tube 14 and connects to the otherwise free end of a cable 52. Thus, a counter weight is provided which will also result in the return of the evacuator to a waiting evacuee.

Having described the structure of the system, procedures for its successful use will now be considered. In an emergency, an evacuee exits the stress situation through an opening adjacent the evacuation system, by first grasping the brake hand control R and pulling it down to its full braking position facing downwardly. The evacuee then grasps the safety grip 56, mounts the evacuator by stepping onto the platform 31 and secures the safety belt 33 about his or her person. By also stepping on the locking brake pedal 35, the brake handle R is secured in the locked position, thereby freeing up both hands to perform other functions, such as securing the safety belt. With the evacuee secured on the evacuator, the brake pedal is released, simultaneously releasing the brake lock and the evacuee then manipulates the handle R to control his or her descent to the next segment. A person on a floor other than where a unit begins or terminates can bring an empty evacuator down to their window, or other access opening by pulling up or down on the cable connected to the companion evacuator. On a large building having several of these systems and serving all floors, the transfer position is preferably on staggered floors so that not all empty evacuators would be waiting on the same floor.

Having now described a preferred embodiment and a modification thereto in some detail, it will be understood that those skilled in the art will be able to visualize other modifications and alterations to the structure, not specifically described. It will be appreciated that all such modifications are within the contemplation of the invention as described in the following Claims, wherein:

The invention claimed is:

1. A system for the evacuation of persons from high rise structures in an emergency, said system being secured to a vertical wall of said structure comprising:

a pair of upstanding vertically oriented discrete tubular posts each attached to said vertical wall; said posts being in close proximity to one another;

at least one evacuator, said evacuator affixed by means of upper and lower sleeves circumscribing said one of said posts for controlled vertical movement along substantially the length thereof; said evacuator adapted to receive an evacuee securely thereon;

a brake mounted to said evacuator and selectively engageable with said post to control the rate of movement of said evacuator relative thereof;

controls on said evacuator, actuatable by an evacuee thereon to control the pressure applied by said brake to said post and, thus, controlling the rate of movement of said evacuator;

said system being segmented such that said posts are extensible over a predetermined distance, such post segments being laterally offset from one another and each said post segment vertically overlapping with a successive post along said vertical wall to or toward ground level;

a cable attached to said evacuator, said cable extending to said other post; a weight at the other end of said cable, said weight acting as a counter balance to said evacuator to return said evacuator to its start position once evacuees have left said evacuator.

2. The evacuation system of claim 1, wherein a safety lock is provided, said safety lock adapted to releasably secure said brake in its locked position relative to said post when said brake has been moved to its locked position, thereby securing said evacuator against movement during mounting and dismounting of said evacuator by an evacuee.

3. The evacuation system of claim 1, wherein a safety belt is provided to be secured about an evacuee to hold said evacuee to said evacuator.

4. The evacuation system of claim 1, wherein a hand grip is provided, said hand grip adapted to provide stability and assist an evacuee in mounting and dismounting the evacuator.

5. The evacuation system of claim 1, wherein said weight is another evacuator.

6. The evacuation system of claim 1, wherein said system, including a pulley at the top of each post, said cable extending over said pulleys.

7. The evacuation system of claim 1, wherein said evacuator is provided with an upper sleeve about a post and a lower sleeve about the same post, said upper sleeve including clamping halves, said halves circumscribing said post, said halves being drawn toward one another for selective frictional engagement therewith to thereby control the descent of said evacuator.

8. The evacuation system of claim 7, wherein said halves are manually drawn together for frictional engagement with said post by means of a clamping screw, a hand control for moving said clamping screw to position said halves to control frictional engagement of said halves with said post.

9. The evacuator system of claim 2, wherein said evacuator includes a platform at the base thereof; a foot pedal on said platform and connected to said brake; said foot pedal adapted to lock said brake in its locked position when said pedal is depressed, and unlocked when said pedal is released.

* * * * *